US006627803B1

(12) United States Patent
Stephens

(10) Patent No.: US 6,627,803 B1
(45) Date of Patent: Sep. 30, 2003

(54) MUSICAL INSTRUMENT BRACE

(76) Inventor: Gene Stephens, P.O. Box 288, 111 Madisonville Rd., Crofton, KY (US) 42217

( * ) Notice: Subject to any disclaimer, the term of this patent is extended or adjusted under 35 U.S.C. 154(b) by 0 days.

(21) Appl. No.: 10/259,444

(22) Filed: Sep. 30, 2002

(51) Int. Cl.[7] ..... G10D 3/00
(52) U.S. Cl. ..... 84/291; 84/267
(58) Field of Search ..... 84/291, 267, 290, 84/280, 294

(56) References Cited

U.S. PATENT DOCUMENTS 3,656,395 A 4/1972 Kaman
3,974,730 A * 8/1976 Adams, Jr. ..... 84/291
4,079,654 A 3/1978 Kasha
5,469,770 A 11/1995 Taylor
6,459,024 B1 * 10/2002 Baker ..... 84/291

* cited by examiner

*Primary Examiner*—Kimberly Lockett
(74) *Attorney, Agent, or Firm*—Richard C. Litman

(57) ABSTRACT

Interior braces for the soundboard of a stringed instrument having reduced mass and more flexibility. The weight of each of the braces is further reduced by apertures selectively formed therein. A standard brace having scalloped ends may be modified according to the invention by introducing apertures of circular or other shape crosswise through the brace, thus forming voids therealong thereby reducing weight and reducing stiffness while maintaining substantially its original strength when glued to the surface of a soundboard. An "I"-beam shaped brace is provided having circular or elongated apertures along the length of the center vertical portion of the brace. A similarly shaped brace is curvilinear in shape having a flat base, concave sides and a rounded apex and having circular apertures along the length of the thin center portion creating voids for reducing weight.

12 Claims, 7 Drawing Sheets

MUSICAL INSTRUMENT BRACE

BACKGROUND OF THE INVENTION

1. Field of the Invention

The present invention relates to musical instruments. More particularly, the present invention relates to interior braces for the soundboard of a stringed instrument.

2. Description of the Related Art

The use of internal braces glued to the inner side of a guitar or other musical instrument soundboard is well known. Many shapes and brace location patterns have been developed to improved the volume or quality of tone of the braced instrument.

A thin, flat soundboard 2, illustrated in FIG. 1 incorporates a prior art bracing called "fan bracing." These fan braces 4 are long, thin pieces of wood with uniform thickness and height. Usually fan braces 4 are spaced closer together near the sound hole 10, gradually wider toward the bridge location 6, and even wider as the braces 4 fan out behind the bridge 6. Large stop braces 12 are located to further support large, thin soundboards. Two additional large stop braces 8 are located to isolate the active portion of the soundboard 2 from the sound hole 10.

The prior braces may be rectangular in cross section or curved as shown in FIGS. 2 and 3 and are made of solid wood glued to the back of the soundboard 2. It is also common to scollop the ends of braces at their ends as shown in FIGS. 2 and 3. Known braces are of solid wood, providing support to the soundboard, but reducing tone volume and quality.

It would be desirable to provide a brace design which has minimum weight and increased flexibility while providing desired bracing to the wood soundboard. Such a brace would increase volume and quality of tone to the instrument when played.

U.S. Pat. No. 3,656,395, issued Apr. 18, 1972, to Kaman, describes braces made of wood such as spruce with their end portions scalloped to reduce the mass, although other shaping of the braces may be use, such as gradual feathering.

U.S. Pat. No. 5,469,770, issued Nov. 28, 1995, to Taylor, describes a catenary bracing design having a generally flat side surface and a curved catenary side surface.

U.S. Pat. No. 4,079,654, issued Mar. 21, 1978, to Kasha, describes the use of torsion bars and tapered acoustical structures adhered to the sound board.

None of the above inventions and patents, taken either singularly or in combination, is seen to describe the instant invention as claimed. Thus, a musical instrument brace solving the aforementioned problems is desired.

SUMMARY OF THE INVENTION

The present invention is directed to interior braces for the soundboard of a stringed instrument. The weight of each of the braces is further reduced by apertures selectively formed therein. A standard brace having scalloped ends may be modified according to the invention by introducing apertures of circular or other shape crosswise through the brace, thus forming voids therealong thereby reducing weight and reducing stiffness while maintaining substantially its original strength when glued to the surface of a soundboard.

Another embodiment of an inventive brace in the shape of an "I" beam is provided, the "I" beam being cut from solid wood, or built up from strips of wood by glueing. Preferably, circular or elongated apertures, or other shaped apertures are introduced along the length of the center vertical portion of the brace creating voids for reducing weight. A similarly shaped brace is provided which is curvilinear in shape having a flat base, concave sides and a rounded apex. The brace may have circular or other shaped apertures introduced along the length of the thin neck portion creating voids for reducing weight.

The inventive braces having reduced weight and stiffness while maintaining required strength when glued to the underside of a soundboard provides more volume and better tone quality to the board as compared to previous braces, allowing the soundboard to vibrate with a larger amplitude while maintaining required strength and stability.

Accordingly, it is a principal object of the invention to provide a brace structure for musical sound board which improves volume and tone quality over those with previous braces.

It is another object of the invention to provide a brace structure as above which reduces mass and retains strength.

It is a further object of the invention to provide a brace structure as above having lateral apertures therethrough spaced along the brace acting as voids to reduce mass.

Still another object of the invention is to provide a brace structure as above having an "I" beam shape or concave sides, thereby minimizing mass while retaining strength in the brace.

Yet another object of the invention is to provide a brace structure as above having lateral apertures therethrough spaced along the "I" portion of the brace acting as voids to reduce mass.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a design for a musical instrument soundboard brace having reduced mass while maintaining strength to support the soundboard.

Figure 4A:
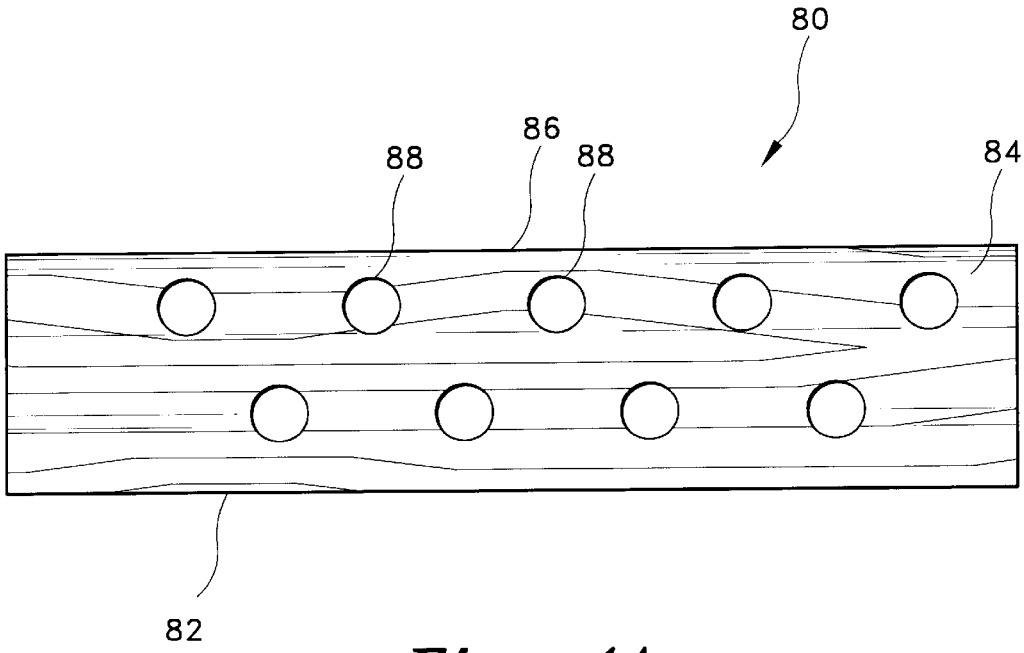
FIG. 4A is a side elevation view of one embodiment of a guitar soundboard brace according to the present invention.
Figure 4B:
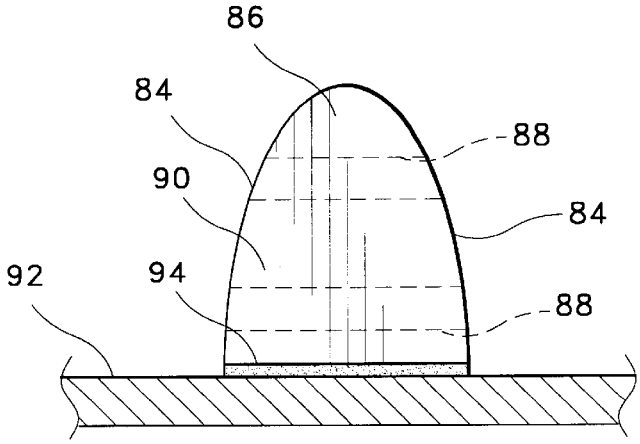
FIG. 4B is an end view of the soundboard brace of FIG. 4A as adhered to a soundboard.

Referring to FIGS. 4A and 4B, there are shown a side elevation view and an end view of one embodiment of the invention wherein brace 80 is of a conventional overall shape. Brace 80 has a flat base 82 for mounting the brace and convex curved sides 84 reaching a peak 86. As seen in FIG. 4A, round lateral apertures 88 are formed such as by drilling between the curved sides 84 to form two offset longitudinal rows of apertures 88 located along upper and lower levels between base 82 and apex 86. This forms voids in the brace, reducing its mass while increasing its flexibility and retaining most of its support strength. The reduction in mass and increase in flexibility results in more volume and an improved tone in the instrument in which the inventive brace is installed. The reduction in mass and increase in flexibility allows the soundboard to more freely vibrate, thus providing the improved volume and tone quality.

Figure 1:
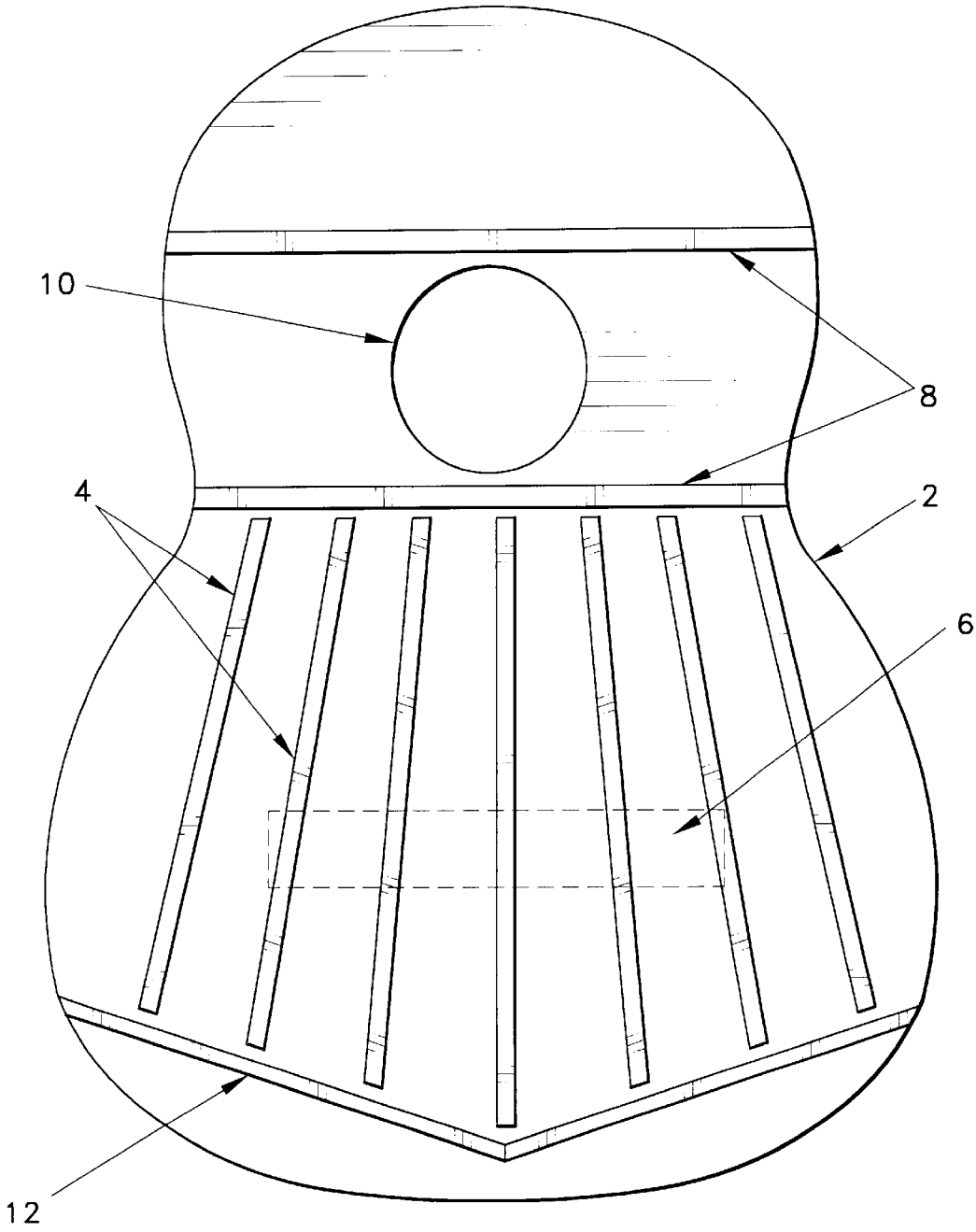
Fig. 1 ( PRIOR ART )
FIG. 1 is a depiction of a prior art braced guitar soundboard.
Figure 2:
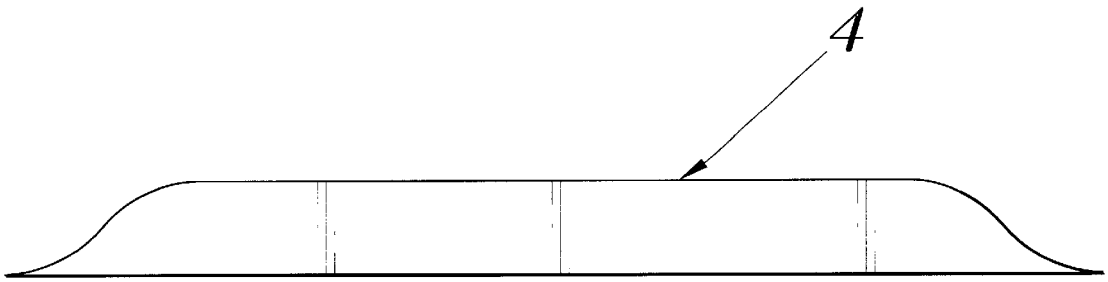
Fig. 2 ( PRIOR ART )
FIG. 2 is a series of side elevation view of the prior art braces shown in FIG. 1.
Figure 3:
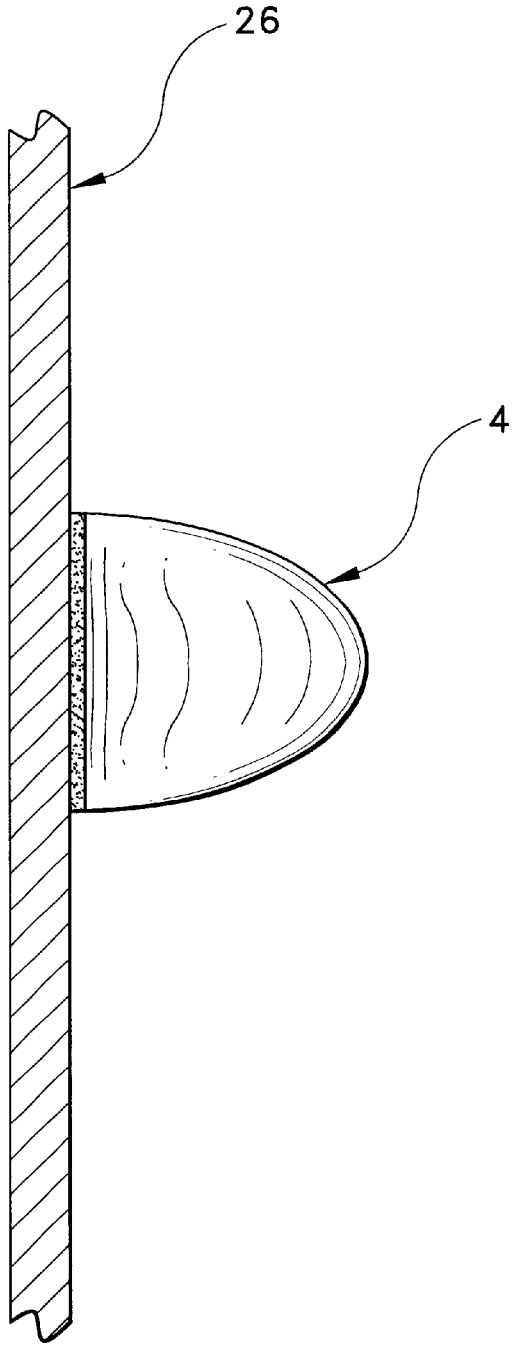
Fig. 3 ( PRIOR ART )
FIG. 3 is a sectional view of a prior art soundboard and brace of FIG. 1.

As seen in FIG. 4B, the conventional profile brace 80 has an end 90 and is attached to the underside of soundboard 92(shown in section) by adhesive layer 94. The ends 90 may be vertical flats as shown or may be scalloped or otherwise curved or tapered as is well known in the art(see the prior art FIGS. 2 and 3).

Figure 5A:
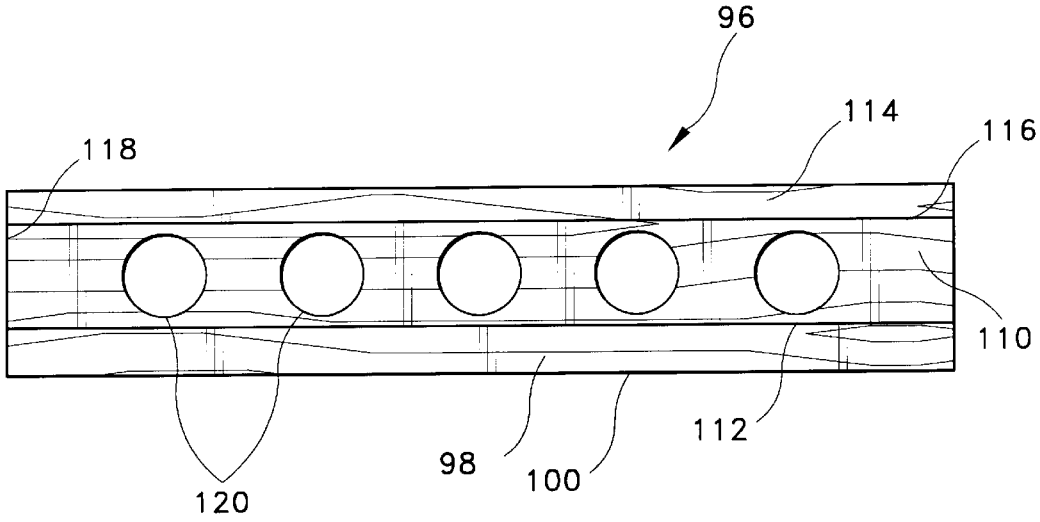
FIG. 5A is a side elevation view of another embodiment of a guitar soundboard brace according to the invention having an "I" beam structure with spaced lateral apertures extending along the "I" portion thereof.
Figure 5B:
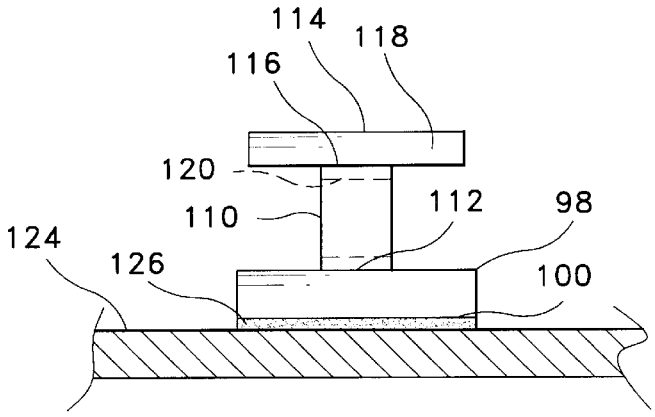
FIG. 5B is an end view of the soundboard brace of FIG. 5A as adhered to a soundboard.
Figure 5C:
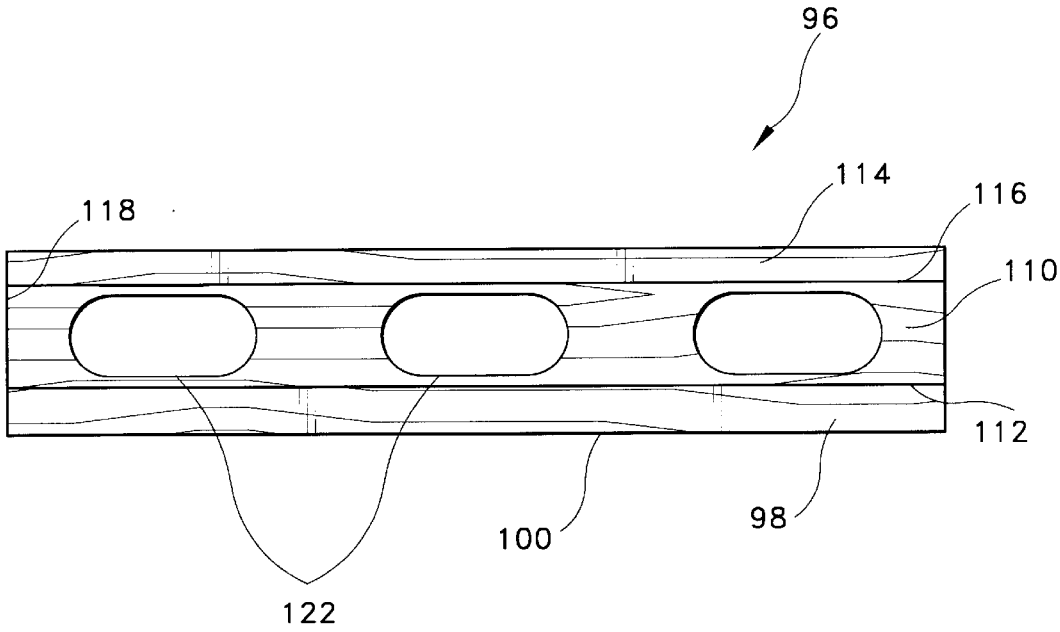
FIG. 5C is a side elevation view of the guitar soundboard brace of FIG. 5A having elongated spaced lateral apertures therealong.

Referring to FIGS. 5A, 5B, and 5C. there is shown another embodiment of the invention in which an "I"-beam construction is employed in the inventive brace. The "I"-beam profile brace 96 is built up from wooden slats through glueing and has a flat base portion 98 having a bottom surface 100, a vertical central portion 110 glued at a lower edge to base portion 98 at connection 112, and a flat upper portion 114 connected with the upper edge of central portion 110 at connection 116. The upper portion 114 may be smaller in width than the lower portion 98 as desired.

The brace 96 has ends 118 and contains round apertures or bores 120 drilled laterally through and spaced along the central portion 110. The bores are of a diameter such as to substantially reach from said lower horizontal portion to said horizontal upper portion. The "I"-beam shaped brace 96 may also be cut from an elongated solid piece of wood by routing if desired.

As seen in FIG. 5B the brace 96 may have flat vertical ends 118 and its bottom surface is attached to soundboard 124(shown in section) by adhesive layer 126. The ends may also be scalloped or otherwise curved or tapered as is well known in the art(see the prior art FIGS. 2 and 3).

As seen in FIG. 5C, "I"-beam profile brace 96 may have elongated apertures 122 or other shaped apertures as desired.

Figure 6B:
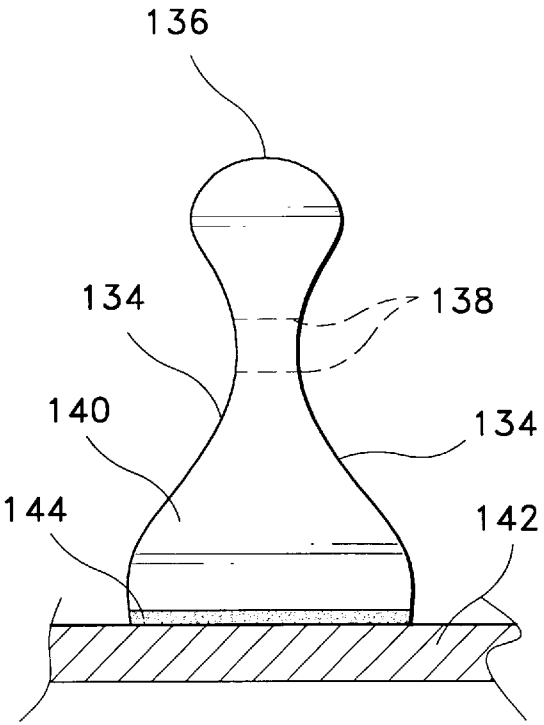
FIG. 6B is an end view of the soundboard brace of FIG. 6A as adhered to a soundboard.
Figure 6A:
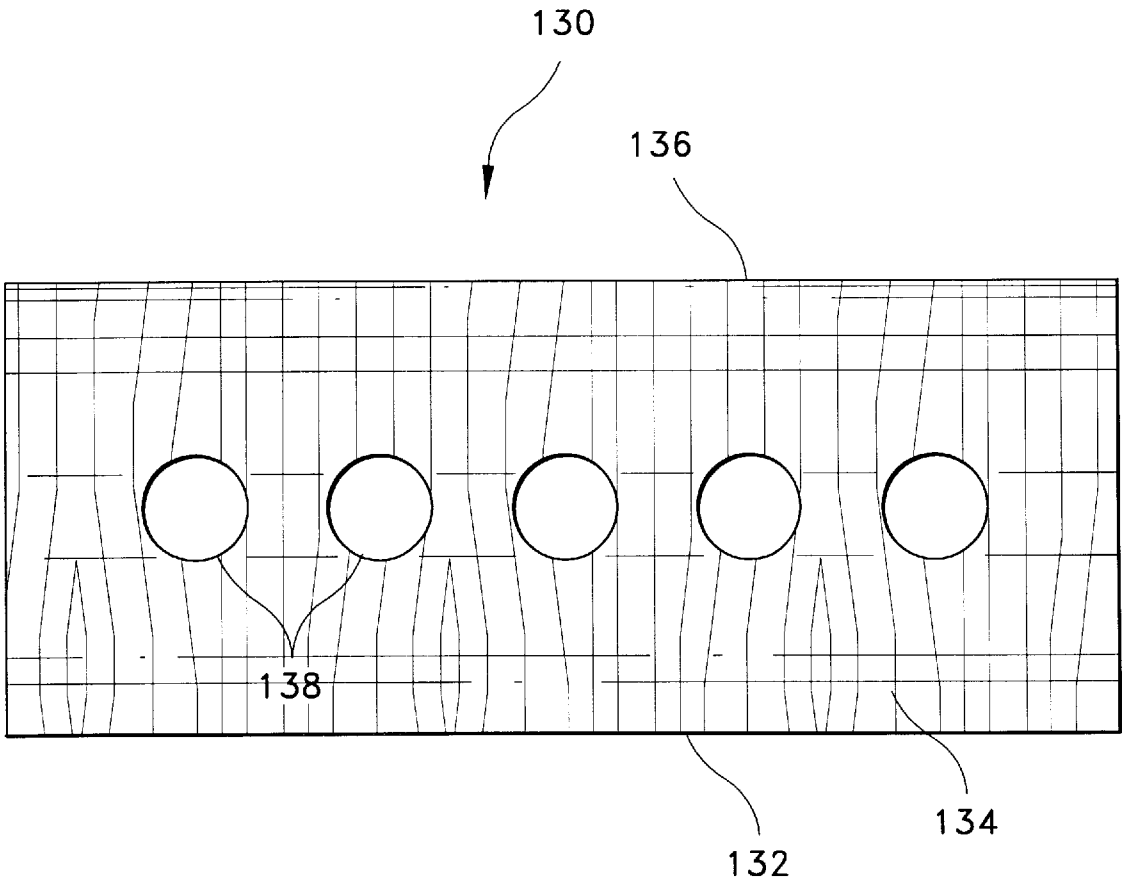
FIG. 6A is a side elevation view of another embodiment of the inventive guitar soundboard brace having concave sides and spaced lateral apertures therealong.

Referring to FIGS. 6A and 6B there is shown another embodiment of the present invention in which a curvilinear profile brace 130 has a flat base 132 and concave side portions 134 forming a neck and ending in a semi-cylindrical peak portion 136. Round lateral apertures 138 are formed as by drilling and spaced along the brace 30 located at a level at about the neck portion of the profile of the brace 130.

As seen in FIG. 6B the brace 130 may have flat vertical ends 140 and its bottom surface is attached to soundboard 142(shown in section) by adhesive layer 144. The ends may also be scalloped or otherwise curved or tapered as is well known in the art(see the prior art FIGS. 2 and 3).

The braces of the present invention are preferably made of wood, but other appropriate materials may be employed. They may be used as replacements for present braces in most musical instruments. The apertures may be of any desired size and shape.

It is contemplated by the invention that other types of voids may be used to reduce mass, such as drilling the braces from end to end or vertically and, although their performance may be inferior to the laterally drilled apertures, such braces are contemplated by the invention. It is also noted that the brace profiles of FIGS. 5B and 6B would reduce mass and therefore be an improvement over the prior braces, and are therefore contemplated by the present invention, they may not be as flexible as the preferred embodiments described above.

It is to be understood that the present invention is not limited to the embodiments described above, but encompasses any and all embodiments within the scope of the following claims.

I claim:

1. A musical instrument brace for soundboards; said brace being elongated in shape and having an upper surface, a generally flat base for attachment to a soundboard, and convex side surfaces extending between said upper surface and said base, said side surfaces converge to form an apex and said upper surface said brace defining lateral apertures therein and spaced therealong, whereby the mass of said brace is reduced while increasing the flexibility of said brace while substantially retaining its bracing strength.

2. The brace of claim 1, wherein the voids defined by said brace are lateral apertures.

3. The brace of claim 1, wherein said lateral apertures are bores extending through said brace between each of said side surfaces.

4. The brace of claim 3, wherein said bores are spaced along said brace and are located along upper and lower levels between said base and said apex.

5. The brace of claim 4, wherein said bores are located such that upper and lower level bores alternate along the length of said brace.

6. A musical instrument brace for soundboards, said brace being elongated in shape and having an upper surface, a generally flat base for attachment to a soundboard, and side surfaces extending between said upper surface and said base, said brace defining voids therein and spaced therealong, wherein said brace is in the general form of an "I"-beam having a lower horizontal portion, an upper horizontal portion and a vertical portion extending between midpoints of said horizontal portions, said base surface being defined by said lower portion, said upper surface being defined by said upper portion, and said side surfaces being defined by said vertical portion, whereby the mass of said brace is reduced while increasing the flexibility of said brace while substantially retaining its bracing strength.

7. The brace of claim 6, wherein said vertical portion defines spaced apertures therealong.

8. The brace of claim 7, wherein said apertures are lateral bores of a diameter such as to substantially reach from said lower horizontal portion to said horizontal upper portion.

9. The brace of claim 6, wherein said apertures are oblong in shape along said vertical portion.

10. A musical instrument brace for soundboards, said brace being elongated in shape and having an upper surface, a generally flat base for attachment to a soundboard, and side surfaces extending between said upper surface and said base, said brace defining lateral apertures therein and spaced therealong, wherein said brace is curvilinear along its length, said sides being concave, forming a neck and extending upward to form a rounded apex, whereby the mass of said brace is reduced while increasing the flexibility of said brace while substantially retaining its bracing strength.

11. The brace of claim 10, wherein said lateral apertures are bores extending through said brace between said side surfaces.

12. The brace of claim 11, wherein said lateral bores are located at a level extending through said neck.

* * * * *